US009119269B2

(12) United States Patent
Spencer et al.

(10) Patent No.: US 9,119,269 B2
(45) Date of Patent: Aug. 25, 2015

(54) LUMEN DEPRECIATION MANAGEMENT

(75) Inventors: Charles Jeffrey Spencer, Wilmette, IL (US); John G. Serra, Pingree Grove, IL (US); Martin Lee, Zionsville, IN (US)

(73) Assignee: Juno Manufacturing, LLC, Des Plaines, IL (US)

( * ) Notice: Subject to any disclaimer, the term of this patent is extended or adjusted under 35 U.S.C. 154(b) by 9 days.

(21) Appl. No.: 13/599,627

(22) Filed: Aug. 30, 2012

(65) Prior Publication Data

US 2014/0062307 A1 Mar. 6, 2014

(51) Int. Cl.
*H05B 37/03* (2006.01)
*H05B 33/08* (2006.01)

(52) U.S. Cl.
CPC ..... *H05B 33/0893* (2013.01)

(58) Field of Classification Search
CPC ..... G01J 1/42; G02B 6/0068; H01J 61/52
USPC ..... 315/112, 129; 356/218; 362/612; 324/414
See application file for complete search history.

(56) References Cited

U.S. PATENT DOCUMENTS

| | | | | |
|---|---|---|---|---|
| 7,839,295 | B2 | 11/2010 | Ries, II | 340/815.45 |
| 8,111,388 | B2 | 2/2012 | Glandt et al. | 356/218 |
| 2004/0212309 | A1 | 10/2004 | St.-Germain | 315/76 |
| 2006/0091827 | A1 | 5/2006 | Chevalier et al. | 315/291 |
| 2006/0091872 | A1 | 5/2006 | Matsuura | 323/283 |
| 2008/0228508 | A1 | 9/2008 | Lyons et al. | 705/1 |
| 2011/0006919 | A1 | 1/2011 | Lundberg et al. | 340/963 |
| 2011/0299068 | A1* | 12/2011 | Glandt et al. | 356/218 |
| 2012/0109386 | A1* | 5/2012 | Crisp, III | 700/283 |
| 2012/0236598 | A1* | 9/2012 | Germain et al. | 362/612 |
| 2013/0030423 | A1* | 1/2013 | Reichert et al. | 606/9 |

OTHER PUBLICATIONS

Juno Lighting, LLC., *Indy™ Performance Series LED Commercial Downlights* Catalog, Feb. 2012 (44 pages).

* cited by examiner

*Primary Examiner* — Thuy Vinh Tran
*Assistant Examiner* — Syed M Kaiser
(74) *Attorney, Agent, or Firm* — Locke Lord LLP

(57) ABSTRACT

A monitoring system is configured to manage lumen depreciation in a lighting fixture and includes an optic housing, a light source with a light-emitting diode (LED), a processor, and a memory device. The memory device stores instructions that cause the monitoring system to measure elapsed time during which the LED light source emits the light and, based on the elapsed time, determine a current level of the emitted light. In response to the current level changing from an acceptable level to an unacceptable level, an alert is provided to show that the emitted light has reached the unacceptable level. A reset input is received to remove the alert for a predetermined period of time. Changes in status of the LED light source are indicated.

16 Claims, 4 Drawing Sheets

LUMEN DEPRECIATION MANAGEMENT

FIELD OF THE INVENTION

This invention is directed generally to lighting systems, and, more particularly, to managing replacement of a light-emitting diode (LED) light source.

BACKGROUND OF THE INVENTION

LEDs are electronic devices that require specific equipment and system designs to ensure that high lumen output and long life are attained and maintained. To ensure specification integrity, a lighting system is typically tested using a viable test methodology. The Illuminating Engineering Society of North America ("IESNA") has developed the "LM79-08 Approved Method: Electrical and Photometric Measurements of Solid-State Lighting (SSL) Products" ("LM79") to standardize this methodology. LM79 test data allows an end user to evaluate the suitability of the SSL system, such as a lighting fixture, for its use in a particular application or to compare SSL systems with one another. LM79 provides data for total luminous flux, electrical power, and efficacy and chromaticity.

The IESNA has also developed the "LM80-08 Approved Method for Measuring Lumen Maintenance of LED Light Sources" ("LM80") to cover lumen maintenance measurement for LED packages, arrays, and modules. LM80 sets the standards for uniform test methods for LED manufacturers, which measure LED lumen maintenance. The LED lumen maintenance is measured while controlling case temperature of the LED, forward voltage to the LED, and forward current to the LED. The LM80 standard also requires lumen maintenance data for at least 6,000 hours of constant DC mode operation.

As such, test results based on the LM79 and LM80 standards provide an accurate estimate of lumen depreciation in a LED lighting system. LEDs are replaced based on the lumen depreciation. The Illuminating Engineering Society (IES) recommends that the LEDs (or any other light source) should be replaced when the light output degrades to about 70% of the initial light output.

SUMMARY OF THE INVENTION

In an implementation of the present invention, a system is directed to managing replacement of a LED light source (e.g., a LED bulb). The system measures elapsed time during which the LED light source outputs light at an initial, acceptable level. If the elapsed time reaches a threshold criteria associated with an unacceptable level of light output, the system provides a notification (e.g., LED light source flashes or is turned OFF) to indicate the unacceptable level. An end user has the option to replace the LED light source or to press a "snooze" button, which allows the LED light source to continue to illuminate for a set amount of time. The set amount of time provides the end user with additional time during which a new replacement LED light source can be procured. The system further allows the LED light source to be dimmed without providing a false indication that the array of LEDs must be replaced.

In another implementation of the present invention, a monitoring system is configured to manage lumen depreciation in a lighting fixture and includes an optic housing, a light source with a light-emitting diode (LED), a processor, and a memory device. The memory device stores instructions that cause the monitoring system to measure elapsed time during which the LED light source emits the light and, based on the elapsed time, determine a current level of the emitted light. In response to the current level changing from an acceptable level to an unacceptable level, an alert is provided to show that the emitted light has reached the unacceptable level. A reset input is received to remove the alert for a predetermined period of time. Changes in status of the LED light source are indicated.

In another alternative implementation of the present invention, a monitoring system is directed to managing depreciation of a LED in a lighting fixture. The system includes a heat sink mounted to a housing and a light source coupled to the housing and having an array of LEDs. The light source has an initial status in which light is emitted at an initial light output. The monitoring system further includes a processor and a memory device storing instructions that, when executed by the processor, cause the monitoring system to perform a plurality of acts. The acts include, based on elapsed time of emitted light, determining a depreciation factor of the emitted light and, in response to the depreciation factor being an unacceptable factor, preventing the light source from emitting light and indicating an unacceptable status. In response to receiving a reset input, the light source is allowed to continue emitting light and to indicate a reset status.

In another alternative implementation of the present invention, a method is directed to monitoring depreciation of an array of LEDs mounted in a lighting fixture. The method includes, based on elapsed time of light emitted by the array of LEDs, determining, via a processor, a depreciation factor of the emitted light. The method further includes, in response to the depreciation factor being an unacceptable factor, (i) extinguishing, via the processors, the light emitted by the array of LEDs to alert an end user that the array of LEDs has reached the end of useful life, and (ii) indicating, via an indicator, a change from an initial status to an unacceptable status. In response to receiving a reset input, (iii) allowing, via the processor, the array of LEDs to continue emitting light, and (iv) indicating, via the indicator, a reset status in which the array of LEDs is allowed to emit light for a predetermined time period.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Figure 1:
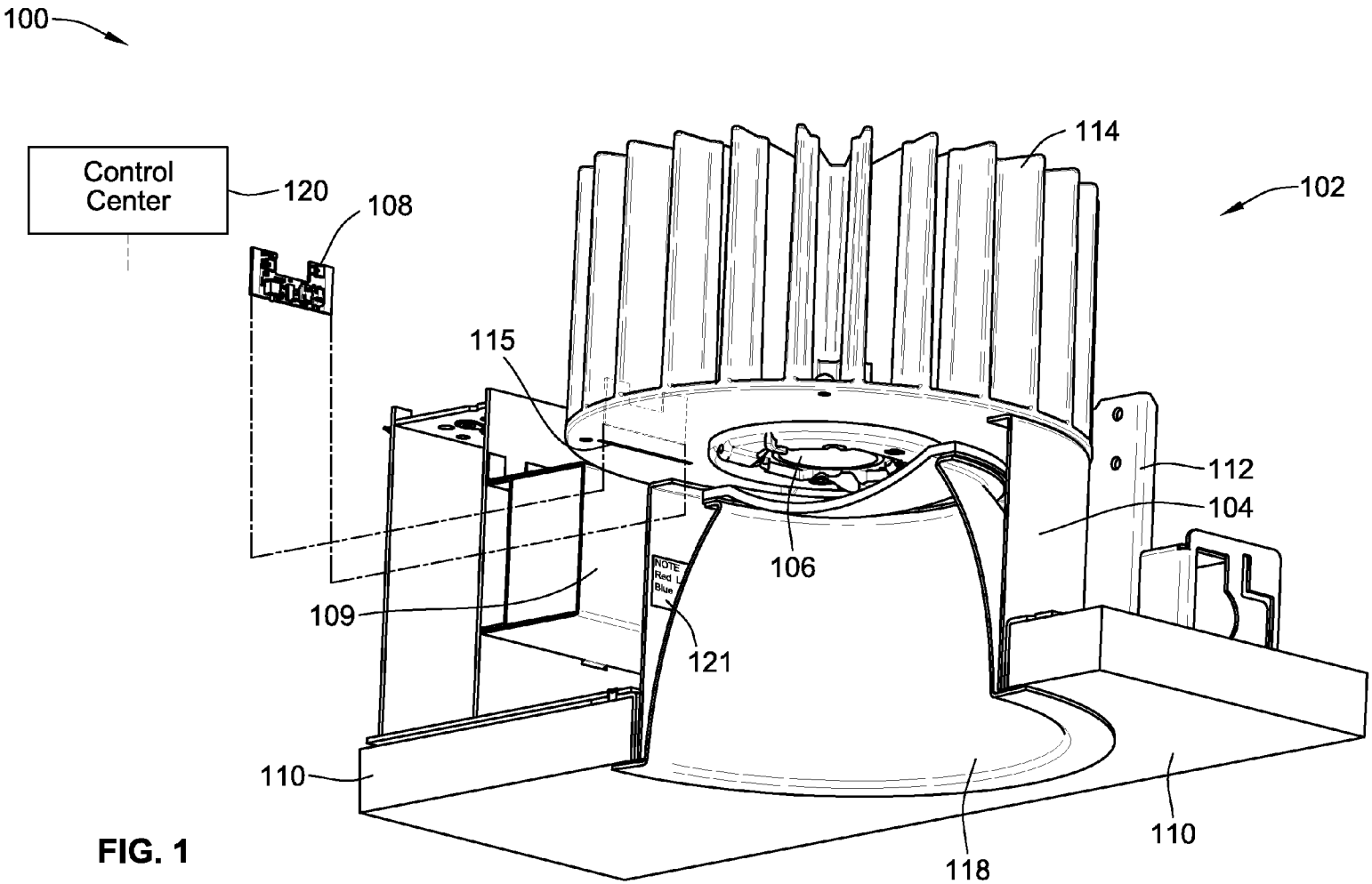
FIG. 1 is a perspective view of a monitoring system for managing lumen depreciation.

Referring to FIG. 1, a monitoring system 100 is configured to manage lumen depreciation in a lighting fixture 102, which includes an optic housing 104, a light-emitting diode (LED) light source 106, a circuit board 108, and a light driver 109.

The monitoring system 100 is intended to help ensure that adequate light levels are maintained in a space as specified in the initial design by an engineer, architect, or lighting designer. The light levels are specified based on test data obtained using standardized methods of the IESNA, including the LM79 and LM80 methods. When the light level of the LED light source 106 depreciates to a degradation level deemed unacceptable and requiring replacement of the LED light source 106, the monitoring system 100 provides an end user the option to extend the time that the LED light source 106 emits light (i.e., stays ON). The option to extend the time avoids safety concerns based on extended light outages due to procurement time for a replacement LED light source. The monitoring system 100 provides the end user with an indication of the current status of the LED light source 106 (e.g., present light level in view of full life cycle of the LED light source 106) and with a way to reset the monitoring system 100 when the time is extended or when a new LED light source is installed.

The optic housing 104 is mountable to a ceiling 110 via an adjustable mounting bracket 112 and is attached to a heat sink 114. According to one example, the heat sink 114 is directly integrated with the optic housing 104 to maintain LED junction temperatures below specified limits. Efficient thermal management, via the integrated heat sink, of the LED junction temperatures is helpful in achieving at least a 70% level of initial LED light output after about 50,000 hours. The 70% level is also referred to as a 0.7 depreciation factor.

The light source 106 is coupled to the optic housing 104 and, in one example, has a LED light engine that includes at least one LED. The LED light source 106 is used as a light source for general illumination, accent lighting, or any other commercial lighting application. According to one example, the LED light source 106 is a chip-on board LED light engine having a 12×12 array of multiple LEDs. According to another example, the LED light source 106 is a remote phosphor LED light engine or any other LED light engine technology. The LEDs are under-driven for exceptional efficiency and for outputting light in the range of about 800 to 2,700 fixture lumens. The chip-on board LED light engine is a modular light engine that is easily replaceable and that helps approach 70 lumens per Watt (lm/W) in efficacy, with various color temperatures, e.g., 2700K, 3000K, 3500K, and 4100K color temperatures, and a minimum color rendering index (CRI) of 80. The LED light source 106 emits light that is directed towards a floor surface or work plane (e.g., a desk surface) through a trim 118.

The light driver 109 is a dimmable LED driver that is electrically coupled to the LED light source 106 and that accommodates voltage inputs of 120 Volts, 277 Volts, or 347 Volts. The dimmable LED driver offers 0-10V dimming and can be easily serviced from above or below the ceiling 110.

The circuit board 108 is mounted within the heat sink 114 in a receiving slot 115, which is located near an outer periphery of the heat sink 114. Optionally, the circuit board 108 is further electrically coupled to a control center 120, such as a building management system. As described in more detail below in reference to FIG. 2, the circuit board 108 is designed to detect a predetermined decrease in the level of light being outputted by the LED light source 106 and, consequently, provide an alert to maintenance personnel.

The optic housing 104 is a commercial-grade housing that features an extra-low profile for easy installation in a variety of applications. The optic housing 104 includes a label 121 that is attached to an interior surface and that has instructions related to the monitoring system 100. The label 121 includes sufficient information for maintenance personnel to determine how to procure and replace the LED light source 106. For example, the information includes identification of the LED light source 106, the lighting fixture 102, manufacturer contact information, indications associated with each status of the LED light source 106, etc. Based on current longevity of LED bulbs, many years (e.g., 6-10 years) may pass between the installation and replacement of the LED light source 106. After such a relatively long period of time, and based on a relatively fast-paced technology growth in the development of LED light engines, it is contemplated that a new, better, and more efficient replacement LED light engine will be developed a the time when the replacement is required. As such, the label 121 provides valuable information to facilitate the replacement of the LED light source 106 with the most appropriate replacement LED light engine available at that time.

Figure 2:
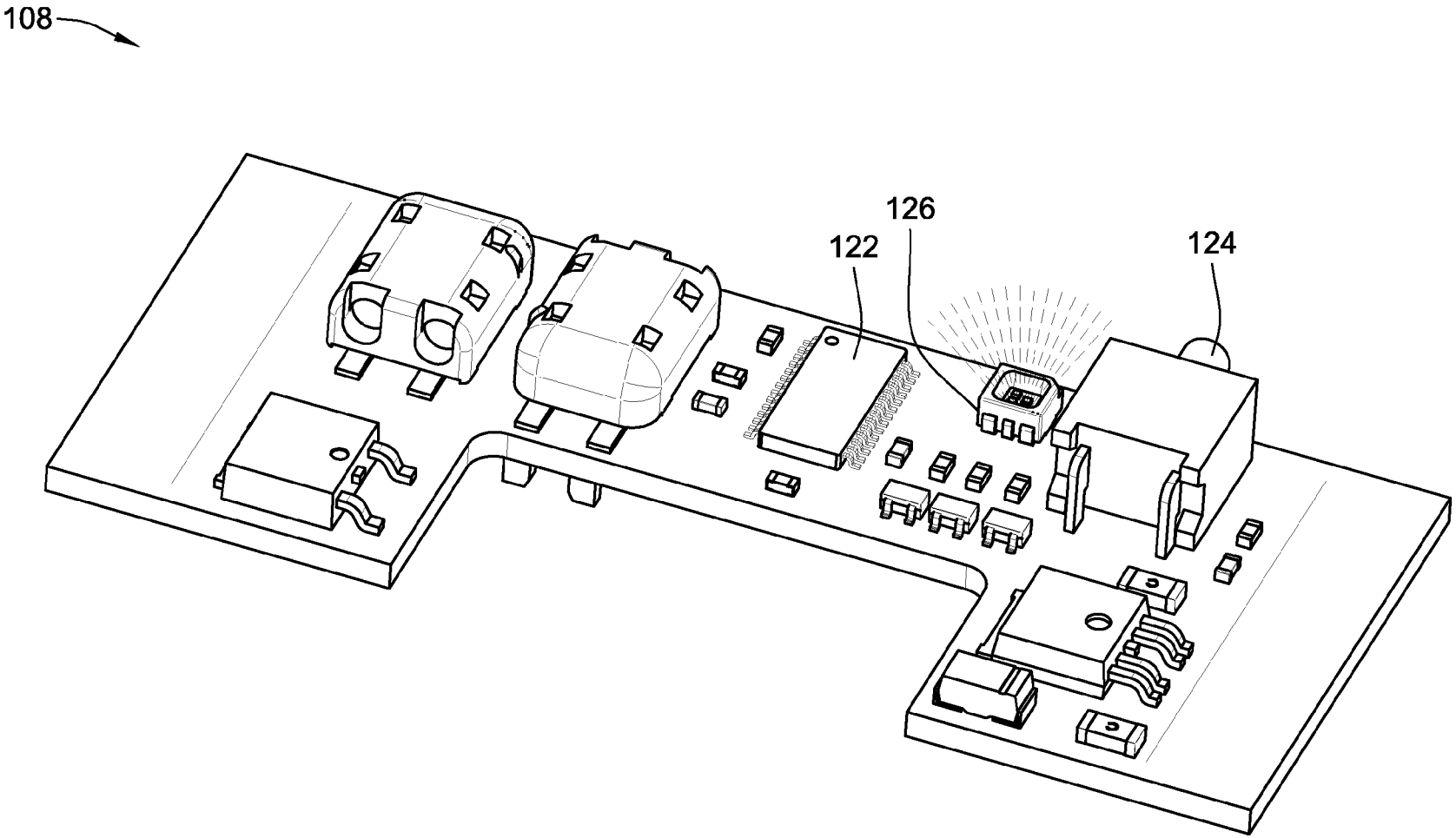
FIG. 2 is a perspective view of a circuit board for the monitoring system of FIG. 1.

Referring to FIG. 2, the circuit board 108 includes a processor and integrated memory device 122, a reset button 124, and an indicator 126. The memory stores instructions that, when executed by the processor, cause the monitoring system 100 to determine and indicate a change in the level of light emitted by the LED light source 106. More specifically, the instructions are designed to use a timer in detecting the end of useful life on the LED light source 106, based on LM79 data associated with the lighting fixture 102 (which is typically supplied by the manufacturer of the lighting fixture 102) and based on LM80 data associated with the LED light source 106 (which is typically supplied by the manufacturer of the LED light source 106). According to one example, the end of useful life is determined in accordance with the 0.7 depreciation factor. Optionally, the processor and the memory device can be located separate from each other and/or remote from the lighting fixture 102. For example, the processor and integrated memory device 122 can be located in the control center 120.

When the LED light source 106 reaches the end of useful life, the circuit board 108 removes electrical power from the LED light source 106 to extinguish the light emitted by the LED light source 106. Alternatively, in another example, the LED light source 106 may provide a flashing light instead of being extinguished. As such, maintenance is alerted that an action must be taken towards the replacement of the LED light source 106. In yet another example, an audible alarm may be included instead of or in addition to the visible alarm provided by the LED light source 106.

In view of the alarm provided by the LED light source 106, the indicator 126 indicates to the end user a current status (or "stage") of life of the LED light source 106. According to the illustrated example, the indicator 126 provides an indication in the form of a continuous light emitted by a multi-color LED, which is distinct from the LEDs of the LED light source 106 and which emits different colors associated with respective status alerts. In yet other examples, the indication can be made using a flashing light or a signal sent to the control center 120 (e.g., to a building management system). Thus, the indicator 126 informs the end user of a status condition of the LED light source 106. For example, the indicator 126 informs the end user that (a) the LED light source 106 is still within the initial rated life in an initial status, (b) the reset button 124 has been used and the LED light source 106 has a reset status, (c) power to the lighting fixture 102 is ON, but the LED light source 106 is extinguished and needs to be replaced, etc. Each status condition can be associated with a different color of the indicator 126, as described in more detail below in reference to FIG. 3.

After receiving the alert, the end user has the option to replace the LED light source 106 or to push the reset button 124 (which acts as a "snooze" button). Pushing the reset button 124 allows the LED light source 106 to continue illuminating for a predetermined time period. After receiving the reset input from the end user, via the reset button 124, the end user is provided with additional time to procure a new replacement LED light source.

In alternative embodiments, the circuit board 108 can include more than one reset button, each reset button being associated with a respective status of the LED light source 106. For example, a first reset button can be included to reset the LED light source 106 for a first extension of time and a second reset button can be included to reset the LED light source 106 for a second extension of time.

Figure 3:
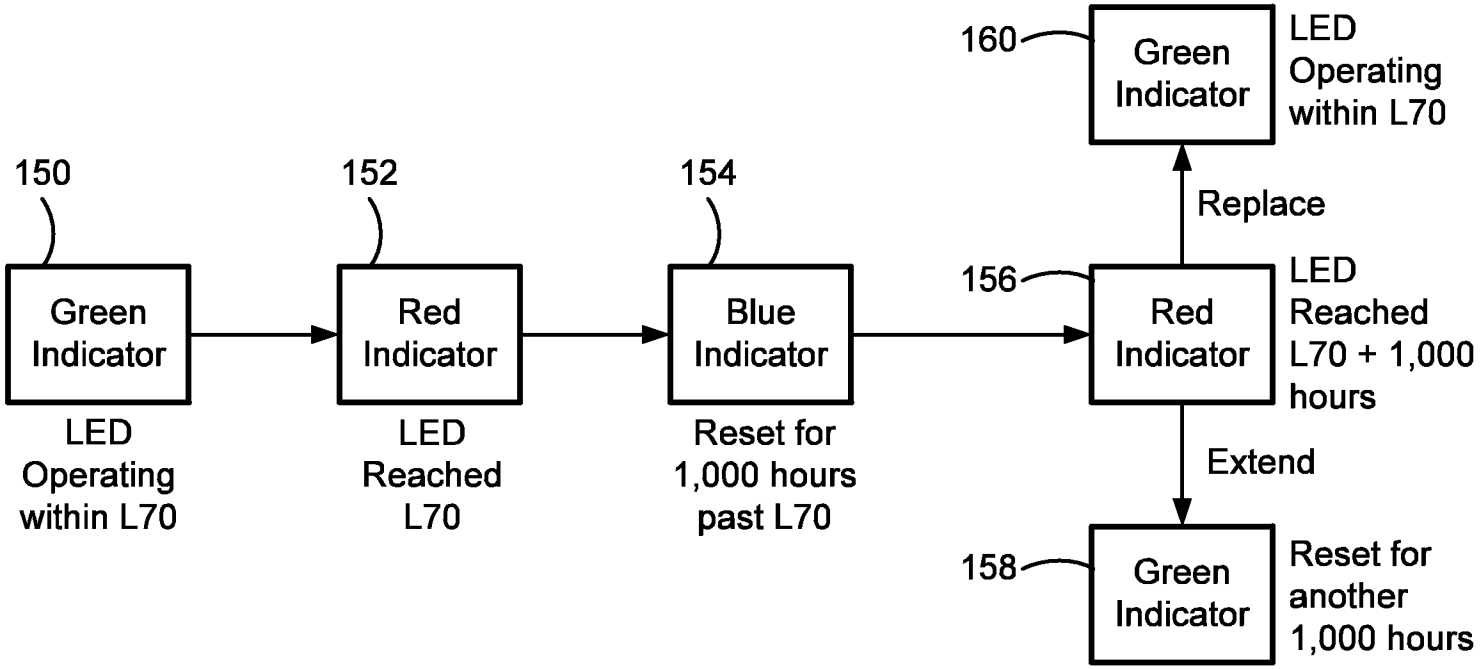
FIG. 3 is a diagrammatic illustrating status indications of the monitoring system of FIG. 1.

Referring to FIG. 3, the indicator 126 is configured as a multi-color LED indicator that emits three different colors: green, red, and blue. Initially, at step 150, when the LED light source 106 operates within its determined useful life, the LED indicator emits a green light to display a "Green indicator" state. According to this example, the useful life of the LED light source 106 is deemed to be light output that is greater than 70% of the initial light output. The green light provides a visual indication to the end user that the LED light source 106 is operating within acceptable limits (also referred to as an initial status of the LED light source 106).

At step 152, when the LED light source 106 has reached the end of its useful life, the LED indicator emits a red light to display a "Red indicator" state. According to this example, the end of the useful life is deemed to be light output that is equal to 70% of the initial light output, as determined based on the LM79 and LM80 test data. The red light provides a visual indication to the end user that the LED light source 106 has now a depreciated status in which light is being outputted at an unacceptable level. As such, the LED light source 106 requires replacement. The LED light source 106 is extinguished at this point.

Then, the end user resets the indicator 126 for a first extended time of 1,000 hours past the end of useful life of the LED light source 106. In other words, according to this example, the end user resets the indicator 126 to 1,000 hours past the level at which light output is equal to 70% of the initial light output. At step 154, the resetting of the indicator 126 results in having the LED indicator emit a blue light to display a "Blue indicator" state. The blue light provides a visual indication to the end user that the LED indicator has been reset and that additional time has been provided to allow for the procurement and replacement of the LED light source 106.

If the end user replaces the LED light source 106, the LED indicator goes back to the "Green indicator" state indicated at step 160. However, according to this example, it is assumed that the end user fails to procure the required replacement LED light engine during the first extended time. As such, the LED indicator emits a red light to display, again, a "Red indicator" state in which the end user is alerted that the LED light source 106 has now reached 1,000 hours past the threshold 70% level. Optionally, to distinguish between (a) the light level reaching the 70% level and (b) the light level reaching 1,000 hours past the 70% level, the LED indicator can use different types of light output. For example, the LED indicator can use a continuous red light at the 70% level and a flashing red light at 1,000 hours past the 70% level.

In response to the LED indicator emitting the red light, at the end of the first extended time period of 1,000 hours, the end user has the option (again) at step 156 to extend the light output of the LED light source 106 or to replace the LED light source 106. If the end user requires additional time to procure a replacement LED light engine, the end user can reset the indicator 126 to a second time period of 1,000 hours. Optionally, the indicator 126 can be reset multiple times, e.g., five times. Regardless of whether the LED light source 106 is replaced or not replaced, the reset button 124 can be held by the end user for a predetermined amount of time (e.g., 10 seconds) to reset the indicator 126.

In response, at step 158, the LED indicator displays the "Green indicator" state. Optionally, the indicator 126 can use distinct alerts to distinguish the first time period from the second time period. For example, the green light emitted by the LED indicator can be a continuous light in the first time period (of 1,000 hours) and flashing light in the second time period (of 50,000). Any other combination of light colors, light types, sounds, and other types of signals can be used to distinguish different states of the indicator 126 and/or the status of the LED light source 106. If the end user has procured and replaced the replacement LED light engine, at step 160, the user holds the reset button 124 for 10 seconds and the LED indicator displays the "Green indicator" state showing normal operation within the 70% threshold of light output.

Figure 4:
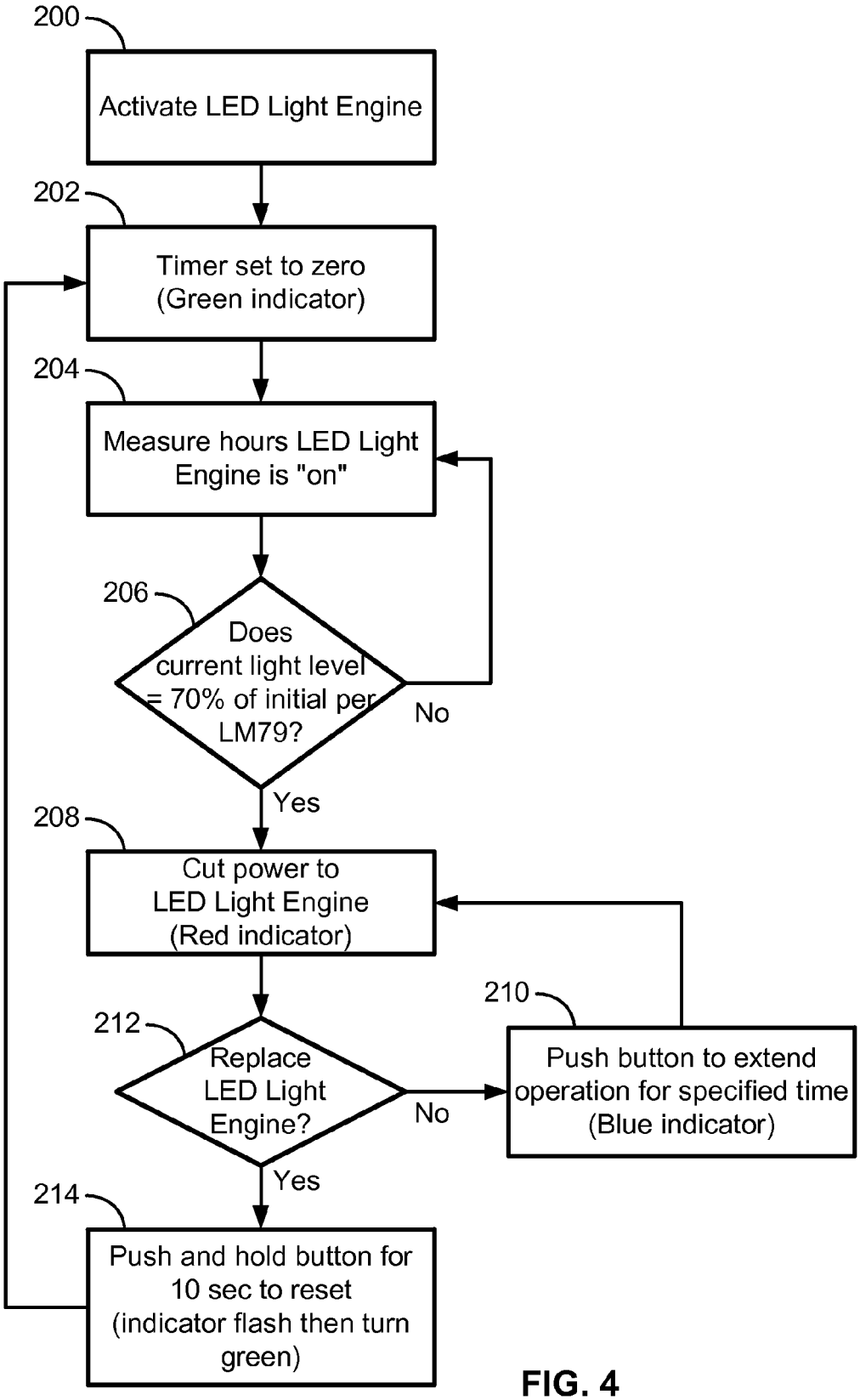
FIG. 4 is a flowchart illustrating a method for managing lumen depreciation.

Referring to FIG. 4, according to a method of managing lumen depreciation, a LED light engine is activated at step 200. The LED light engine has an initial status in which light is emitted at an acceptable level. For example, the acceptable level is deemed to be a level in which light is emitted at greater than 70% of an initial light output. A timer is set to zero at step 202 and a Green indicator emits green light to show that the LED light engine is operating with the acceptable level of light output. At step 204, the timer measures (or counts) the number of hours during which the LED light engine is ON. In other words, the timer measures elapsed time from a start time to a current time during which the LED light engine emits light.

At step 206, a determination is made whether a current light level is equal to 70% of an initial light level. The determination is made based on LM79 test data and can be made at predetermined time intervals, e.g., every minute, every hour, etc. If the current light level is not equal to 70% of the initial light level, the timer continues to measure the hours during which the LED light engine is ON (step 204). If the current light level is equal to 70% of the initial light level, at step 208, electrical power is removed from the LED light engine (which is now OFF) and a Red indicator visually indicates to the end user that the end of useful life of the LED light engine has been reached. In effect, the LED light engine is prevented from emitting light until further action is taken by the end user. Thus, if the current light level is equal to 70% of the initial light level, a determination is made that the light level has changed to an unacceptable level. Consequently, an indicator indicates the change from the initial status of the LED light engine (associated with an acceptable level of light output) to a depreciated status of the LED light engine (associated with an unacceptable level of light output). Meanwhile, the LED light engine is OFF.

If the end user replaces the LED light engine, at step 212, the end user presses and holds a reset button at step 214 for 10 seconds to reset the LED light engine back to normal operation indicative of the LED light engine operating with a light output greater than 70% of the initial light level (as determined based on LM79 test data). Alternatively, if the end user does not replace the LED light engine, at step 212, the end user can push the button at step 210 for a period less than 10 seconds to extend operation of the LED light engine for a specified time period. The extended operation, during which the LED light engine has a reset status, is visually represented to the end user using a Blue indicator.

The Green, Red, and Blue indicators can be represented via a single LED indicator, which emits (as required) green, red, and blue lights. Optionally, each of the Green, Red, and Blue indicators can be a separate and distinct indicator emitting the respective green, red, and blue lights. Other colors may be used, as well, as long as the label 121 reflects the status associated with each color.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A monitoring system configured to manage lumen depreciation in a lighting fixture, the system comprising:
- an optic housing mountable to a ceiling via a mounting bracket;
- a light-emitting diode (LED) light source coupled to the optic housing, the LED light source emitting light initially at an acceptable level;
- a processor;
- a memory device storing instructions that, when executed by the processor, cause the monitoring system to:
  - measure elapsed time from a start time to a current time during which the LED light source emits the light;
  - based on the elapsed time, determine a current level of the emitted light;
  - in response to the current level of the emitted light changing from the acceptable level to an unacceptable level, provide an alert to show that the emitted light has reached the unacceptable level;
  - in response to receiving a reset input, removing the alert for a predetermined period of time; and
  - indicate changes in status of the LED light source; and
- a label with instructions for replacement of the light source, the label being attached internally to the lighting fixture, the instructions including (a) identifying information of the LED light source and the lighting fixture, (b) manufacturer contact information, and (c) indicator information describing indications associated with each LED light source status.

2. The monitoring system of claim 1, wherein the alert is selected from a group consisting of extinguishing the LED light source, emitting a flashing light by the LED light source, and an audio output.

3. The monitoring system of claim 1, wherein the changes in status are indicated via a single indicator.

4. The monitoring system of claim 3, wherein the indicator is a multi-color LED emitting a plurality of colors associated, respectively, with each status of the LED light source.

5. The monitoring system of claim 4, wherein the multi-color LED emits a first color for indicating an initial status of the LED light source in which light is emitted at an acceptable level, a second color for indicating a depreciated status of the LED light source in which light is emitted at an unacceptable level, and a third color for indicating a reset status of the LED light source in which light is emitted during the predetermined period of time.

6. The monitoring system of claim 1, further comprising a reset button for receiving the reset input.

7. The monitoring system of claim 1, further comprising a heat sink mounted to the optic housing, the processor being on a circuit board mounted to the heat sink.

8. The monitoring system of claim 1, wherein, upon conclusion of the predetermined period of time, at least one other reset input is received to continue the removal of the alert for an additional predetermined period of time.

9. A monitoring system for managing depreciation of a light-emitting diode (LED) in a lighting fixture, the system comprising:
- a heat sink mounted to a housing;
- a light source coupled to the housing and having an array of LEDs, the light source having an initial status in which light is emitted at an initial light output;
- a processor;
- a memory device storing instructions that, when executed by the processor, cause the monitoring system to:
  - based on elapsed time of emitted light, determine a depreciation factor of the emitted light,
  - in response to the depreciation factor being an unacceptable factor, prevent the light source from emitting light and indicate an unacceptable status; and
  - in response to receiving a reset input, allow the light source to continue emitting light and indicate a reset status; and
- a label attached to the lighting fixture and including instructions for replacement of the light source, the instructions including (a) identifying information of at least one of the LED and the lighting fixture, (b) manufacturer contact information, and (c) indicator information describing indications associated with each LED status.

10. The monitoring system of claim 9, further comprising an indicator for indicating each status of the light source.

11. The monitoring system of claim 10, wherein the indicator is a multi-color LED emitting a plurality of colors associated, respectively, with each status of the LED light source.

12. The monitoring system of claim 9, further comprising a reset button to receive the reset input when the reset button is depressed.

13. The monitoring system of claim 9, further comprising a circuit board on which at least one of the processor and the memory device is mounted, the circuit board being mounted in the heat sink.

14. The monitoring system of claim 9, wherein the processor is located remote from the lighting fixture.

15. The monitoring system of claim 9, wherein the depreciation factor is 0.7.

16. A monitoring system configured to manage lumen depreciation in a lighting fixture, the system comprising:
- an optic housing mountable to a ceiling via a mounting bracket;
- a light-emitting diode (LED) light source coupled to the optic housing, the LED light source emitting light initially at an acceptable level;
- a processor; and
- a memory device storing instructions that, when executed by the processor, cause the monitoring system to:
  - measure elapsed time from a start time to a current time during which the LED light source emits the light;
  - based on the elapsed time, determine a current level of the emitted light;
  - in response to the current level of the emitted light changing from the acceptable level to an unacceptable level, provide an alert to show that the emitted light has reached the unacceptable level;
  - in response to receiving a reset input, removing the alert for a predetermined period of time; and
  - indicate changes in status of the LED light source, wherein the stored instructions, when executed by the processor, cause the monitoring system further to:

in response to the current level of the emitted light changing from the acceptable level to the unacceptable level, cut power to the LED light source, in response to receiving the reset input, allow the LED light source to emit light during the predetermined time even if the LED light source is operating at an unacceptable level, and in response to an end of the predetermined time, cut power to the LED light source.

* * * * *